US005841055A

United States Patent [19]

Hooper et al.

[11] Patent Number: 5,841,055

[45] Date of Patent: Nov. 24, 1998

[54] METHOD FOR CONTROLLED REFINING OF EXPLOSIVE COMPOSITIONS

[75] Inventors: Allan Hooper, North Bay; Les Collins, Corbell; Earl Reckzin; Andrew Richard, both of North Bay; Tom Palangio, Bonsfield; Mark Kelly, Callander; Grant Simpson, North Bay, all of Canada

[73] Assignee: ETI Explosives Technologies International (Canada) Ltd., North Bay, Canada

[21] Appl. No.: 872,926

[22] Filed: Jun. 11, 1997

Related U.S. Application Data

[62] Division of Ser. No. 548,673, Oct. 26, 1995, Pat. No. 5,672,839.

[51] Int. Cl.[6] ..... F42B 3/00

[52] U.S. Cl. ..... 86/20.15

[58] Field of Search ..... 86/20.15

[56] References Cited

U.S. PATENT DOCUMENTS

| | | | |
|---|---|---|---|
| 3,380,333 | 4/1968 | Clay et al. | 86/20 |
| 3,690,213 | 9/1972 | Grant | 86/20 C |
| 4,008,108 | 2/1977 | Chrisp | 149/2 |
| 4,195,548 | 4/1980 | Cook et al. | 86/1 R |
| 4,273,147 | 6/1981 | Olney | 137/13 |
| 4,397,354 | 8/1983 | Dawson et al. | 166/294 |
| 4,462,429 | 7/1984 | Coursen | 137/891 |
| 4,510,958 | 4/1985 | Coursen | 137/13 |
| 4,685,375 | 8/1987 | Ross et al. | 86/20.15 |
| 4,966,077 | 10/1990 | Halliday et al. | 102/313 |
| 4,995,802 | 2/1991 | Müller et al. | 425/154 |
| 5,114,630 | 5/1992 | Newman et al. | 264/3.1 |
| 5,447,090 | 9/1995 | Adams | 86/20.15 |

FOREIGN PATENT DOCUMENTS 1256305 6/1989 Canada .

*Primary Examiner*—Peter A. Nelson

[57] ABSTRACT

An apparatus for the controlled refining of an emulsion explosive composition is shown. The apparatus includes a pump for pumping the pumpable explosive composition, a conduit for transporting the explosive composition away from the pump, and a refining or shear valve located in the conduit. Also provided is control instrumentation which allows the amount of refining to be monitored. The preferred control instrumentation comprises a first pressure indicator located on an upstream side of said valve, the second pressure indicator located on the downstream side of said valve, and an adjustor associated with the valve to allow the valve to be adjusted to produce a predetermined pressure difference between the first and second pressure indicators.

9 Claims, 3 Drawing Sheets

METHOD FOR CONTROLLED REFINING OF EXPLOSIVE COMPOSITIONS

This application is a division of 08/548,673, filed on Oct, 26, 1995, and now U.S. Pat. No. 5,672,839.

FIELD OF THE INVENTION

This invention relates generally to the field of explosives, and more particularly to pumpable explosives which may, for example, be loaded into a borehole. In particular this invention relates to methods and equipment for improved pumping and loading of, for example, boreholes with such pumpable explosive compositions.

BACKGROUND OF THE INVENTION

Many different types of explosive compositions are known, including water gels, which are formed with cross linking agents in an external water phase, slurry explosives, which also are formed with an external phase of water, and emulsion explosives, which are formed with an external oil phase. More recently emulsion explosives have become more popular because of their properties, which include good water resistance and pumpability. The improved water resistance is derived from the external oil phase which of course, is not miscible with water and thus the integrity of the explosive charge can be maintained, even when loading a wet borehole, which may often be the case in the field. No liners, expensive cross linking agents or other water prevention methods are necessary with emulsion explosives where the eternal phase is oil.

Emulsion explosive also demonstrate another property, which in some ways facilitates the use of the explosive composition in loading boreholes. Essentially, emulsion explosive compositions tend to become more viscous, the more they are refined. Refining, such as by shearing, decreases the size of the dispersed water droplets. The smaller the droplets in general, the more viscous or thicker the emulsion explosive is. Thin emulsion compositions which have relatively large droplets are referred to as coarse emulsions, and thick or viscous emulsions with finer droplets are called fine emulsions.

In the prior art there have been examples of ways to take advantage of this property, namely that the explosive composition thickens the more it is sheared. For example in Chrisp, U.S. Pat. No. 4,008,108, teaches that using a high shear mixer, namely a shear pump, shortly before loading packaging sleeves with emulsion explosives, results in the product thickening in the packaging sleeves to make it more easily transported and handled during loading.

More recently, Miller, U.S. Pat. No. 4,615,712, has taught the use of a shear valve located at the end of a loading hose, for the purpose of pumping explosive compositions directly into boreholes. The patent teaches the explosive composition can be pumped at low viscosity and sheared as the explosive composition leaves the hose and enters the borehole. The explosive composition that is deposited in the borehole is thus shear thickened, and more viscous than the composition that was pumped to the hole. This allows lower pumping pressures to be used and reduces the sizes of the hose and pump required and the like.

However there are numerous problems associated with this approach. The amount of shear imparted to an emulsion (and hence the amount of thickening) is related to the pumping speed, and the degree of valve opening. Where the shear valve is placed at the end of a hose, which end is, for example inserted into the borehole as taught in Miller, changes in pumping conditions result in inconsistent shearing. Variations in shearing result in changes in viscosity which can result in poor explosive placement or loading. This can affect the characteristics and thus the effectiveness of the blast The method taught by Miller of loading an up borehole is to place the nozzle at the top end of the borehole and gradually withdraw it as the borehole is loaded, hoping that the loaded explosive is viscous enough to be self supported in the borehole and not add any hydraulic head to the loading operation. But thehydraulic head clearly changes as the hose exit is lowered. Because the valve is remote from any operators, there is no ability to adjust the valve during such loading operations to meet the changing pumping conditions that might occur as loading progresses. Without any ability to monitor or control the amount of refining that takes place during pumping inconsistent results are inevitable.

A further problem arises from the mixing that the shear valve requires at the exit of the hose. It is known in the explosives art to use a lubricating annulus, for example of water, to lower the pumping head that is otherwise required to pump emulsion explosives. With the method taught by Miller any water used as a lubricating annulus is mixed into the explosive composition at the exit from the hose. Poor or inadequate mixing will result in changes to the explosive characteristics of the composition. As noted above, changes in pumping conditions, which are inevitable, will result in a change in the amount of shear or mixing. Thus it is very difficult, in practice, to achieve the desired mixing to optimize the explosive characteristics. This leads to substandard explosions and increased costs and waste.

SUMMARY OF THE INVENTION

What is desired therefore is a method and apparatus of pumping emulsion explosive compositions which allows for the composition to be delivered to the borehole at or about a desired predetermined viscosity, which has been previously identified as being the optimum for that particular composition. The preferred method should allow the viscosity to be maintained at the target viscosity even if the pumping conditions change as the explosive composition is being loaded into the borehole. As noted above, the pumping conditions inevitably change due to changes in the elevation of the exit from the hose, or because the hydraulic head of the fluid above the exit from the hose changes. Pressure could also change if the composition being pumped changes in viscosity, such as might occur for slight variations in mixtures due to temperature or moisture effects at the loading site.

A method and apparatus that allows an up or sideways borehole to be loaded by merely placing an end of the hose into the borehole and using a hydraulic packer or seal to seal the nozzle to the borehole mouth is also desired because this is much easier for operators to use and does not require the precise withdrawal of the hose from the hole as it is loaded as described above. It is also preferred if such a system avoids mixing the pumped composition at the hose exit, so that when product is loaded into a down borehole, for example, any water lubrication will be simply allowed to ride on top of the loaded composition (since the explosive composition will typically be denser man water and not miscible therewith), without being mixed in and adversely affecting the explosive characteristics.

What is also desired is a method and apparatus which is relatively easy to use, and one that is likely to achieve conduct results in spite of the robust environment and operators of this type of equipment.

Therefore according to one aspect of the present invention there is provided:

An apparatus for pumping and thickening pumpable explosive compositions, the apparatus comprising:

a pump means for pumping said pumpable explosive;

a conduit for transporting said explosive composition away from said pump;

a refining means located in said conduit;

a control means for measuring a parameter which is related to the amount of refining occurring in said refining means; and an adjustor wherein said adjustor is adjusted to cause said refining means to produce a predetermined optimum value of said measured parameter.

According to a further aspect of the present invention there is also provided:

A method for controlled pumping and thickening of a pumpable explosive, the method comprising the steps of.

a) pumping an explosive composition through an apparatus having a pump, a conduit for porting said explosive composition away from said pump;

a refining means located in said conduit;

a first pressure indicator located on an upstream side of said of said refining means;

a second pressure indicator located on a downstream side of said refining means; and an adjustor associated with said refining means;

b) establishing a set point pressure differential between said first pressure indicator and said second pressure indicator for attaining a predetermined amount of thickening of said explosive composition through said refining means;

c) monitoring the pressure difference between the first pressure indicator and the second pressure indicator; and d) adjusting said apparatus to maintain said set point pressure differential.

BRIEF DESCRIPTION OF THE DRAWINGS

Reference will now be made to the attached drawings which depict, by way of example only, preferred embodiments of the invention and in which.

DETAILED DESCRIPTION OF THE PREFERRED EMBODIMENTS

Figure 1:
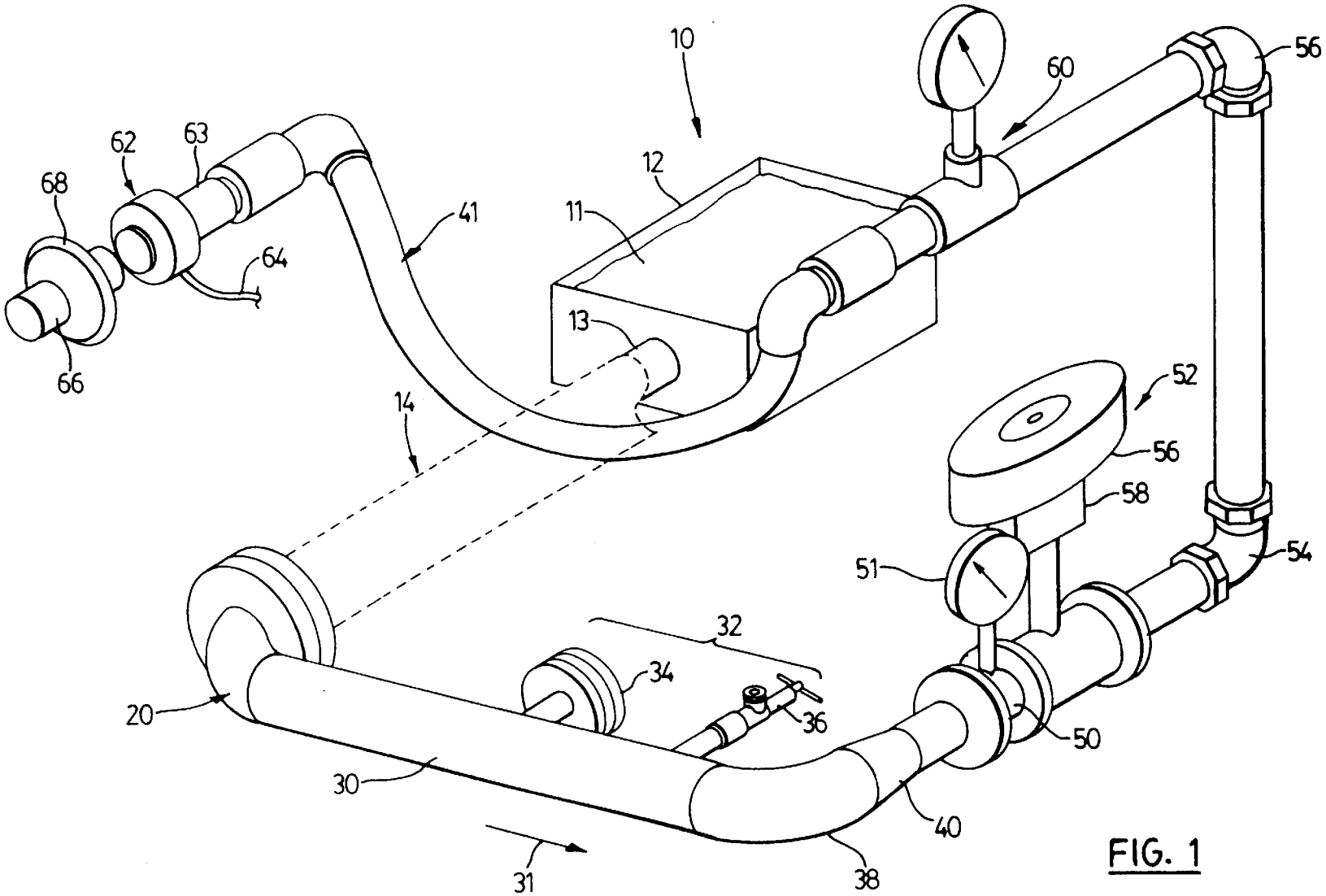
FIG. 1 is a schematic view of an apparatus for pumping and thickening explosive compositions according to one aspect of the present invention.

FIG. 1 shows an apparatus 10 for pumping and thickening explosive compositions according to the present invention. The explosive composition may be stored for example in a bulk discharge tank, located close to the apparatus 10. A source of pumpable explosive 11 is shown schematically as 12 in FIG. 1.

In this context pumpable explosive composition means any explosive composition which is pumpable at standard operating conditions. The preferred type of pumpable explosive composition is a water in oil emulsion explosive composition, having an aqueous discontinuous phase containing dissolved oxygen supplying salts, a carbonaceous or fuel phase which is continuous (external) and an emulsifier. As will be appreciated by those skilled in the art, there are many blends possible of these and additional ingredients, such as occluded gas and the like, depending upon the desired explosive characteristics. However, this invention is applicable to such pumpable explosive compositions as are capable of being thickened by refining a course emulsion into a fine emulsion. The preferred method of refining such a pumpable explosive composition is by passing the composition through a restricting orifice, which shears the composition. However there are other ways of refining the composition, such as through the use of a high speed mixer which are also comprehended by this invention Tuning back to FIG. 1, a tank discharge tube 13 leads to a pump means shown as 14. The preferred form of the pump means 14 is a Dresser MONOFLOW pump made by Dresser Pumps. This pump is of the single screw progressive cavity positive displacement pump type. The pump 14 is capable of producing a reasonably constant flow over its operating pressure range, regardless of the pressure. Thus pump flow is generally proportional to speed of the screw and at a constant speed the pump will provide a reasonably constant flow. As explained more fully below this characteristic is important because the pumping procure is likely to change under certain pumping conditions, and if the flow rate were to vary to greatly with such pressure changes, unwanted changes in shearing rate could occur.

The preferred pump 14 is characterised in having a complex wave like rotor that fits within a rubber lined stator. Even when used to pump viscous media, such as pumpable explosives, the pump has a very low shear rate of liquids travelling through the pump. Thus the preferred pump provides a minimum change to the pumpable explosive emulsion as the emulsion is pumped through the pump.

It will be appreciated that other pumps will also be suitable for pumping the explosive composition. However, to be suitable the pumps' effect on the explosive composition must be understood. Pumping conditions can change over the course of loading a borehole, and thus pressure at the pump can also change. A positive displacement pump is thought to provide the most consistent results.

Next, the explosive composition flows through an elbow 20, and through a section of pipe 30 (as indicated by arrow 31) having a pressure safety system 32. The pressure safety system includes a rupture disc 34 and a pressure relief valve 36. A preferred form of pressure relief valve 36 is a three quarter of an inch adjustable valve. The pressure relief valve 36 is set at a pressure release slightly below the rupture disc 34 and provides temporary pressure relief. For example if the rupture disc 34 is set to rupture at 400 psi, the pressure relief valve 36 will be set at about 390 psi. The rupture disc 34 provides a permanent break of the line, whereas the pressure release valve 36 is a temporary release primarily to protect the rupture disc 34.

Next, there is a further elbow 38, followed by a reducing connection 40. The reducing connection 40 changes the diameter from three inches to two inches. Two inches is preferred because the pumpable explosive is eventually sent through a flexible hose 41 which is manually manipulated at the borehole. Too large a hose diameter would make the hose 41 impossible to lift once the hose 41 is filled with explosive composition and thus the two inch diameter is preferred as being generally manageable to workers operating the equipment. It will be appreciated that with mechanical assistance, or other equipment, larger diameter hoses may be used, but two inch is preferred for ease of use and simplicity Next, there is a first pressure gauge 50. This pressure gauge or sensor may be of any number of types, but a E.V.R Model WPS-30-NBR Elasto-valve Rubber Products Inc. of Sudbury, Canada has been found to provide suitable results. This device is a two inch carbon steel wafer style pressure sensor having an ANSI Class 300 lb. pressure rating and includes a Wika pressure gauge type 233-54 shown as 51. The first pressure gauge 50 measures the pressure in the system just after the reducing connector 40.

Next, there is a refining means 52, which is used to refine the explosive composition being pumped, by causing the explosive composition to shear as it moves past the refining means 52. Although a number of different components could be used as the refining means 52, such as high speed shearing mixer, valves, such as ball, gate or spring loaded valves, are preferred. The most preferred form of the refining means 52 is a globe valve. This type of valve is preferred because it provides a predictable pressure drop in relation to the size of the opening. Further it is believed that the shape of the valve renders it more effective, and having regard to hydraulic losses it more efficient. It has been found that a globe valve was able to achieve the same shear as a spring loaded valve, but at a lower pressure. The preferred form of the valve is a Model #21124 Masoneilan 21000 Series Control Valve, which is a two inch ANSI Class 300 R.F globe valve made by Masoneilan Dresser. The preferred valve includes a Model 87 Pneumatic spring diaphragm actuator with a Model 8012 Electropneumatic Valve positioner which are discussed in more detail below.

The term refining means as used herein, means any device capable of imparting controlled shearing to a flowing stream of pumpable explosive composition, such as a water in oil emulsion. The valve can assume any particular mechanical configuration which adjustably obstructs the flow of the pumpable explosive. A positionable valve is required to allow for an finely adjustable range of settings which in turn correlates to an range in the amount of shear, which in turn relates to a range in the output viscosities. As will be appreciated, the more dosed the valve means, the greater the shear imparted into the explosive composition. Thus at higher shear rates, small changes in position can have a large impact on the shearing effect. Therefore a nonlinear actuator, as described above is the most preferred to allow for precise adjustment of the shearing of the explosive composition over the operating range of the equipment.

Further downstream from the refining means 52 are two elbows 54,56 which have the effect of bringing the pipe back past the refining means 52. Located on the downstream pipe, in easy sight of the refining means 52 is a second or downstream pressure gauge 60. This pressure gauge 60 is again of any standard type, and may be of the same type as noted above for the first pressure gauge. It will be appreciated that the positioning of the pressure gauges 50, 60 or sensors is a matter of choice. For a manually operated system, it is preferred to have the dials for the two pressure gauges 50,60 dearly in sight at the refining means 52 station. However, it is also possible to automate the system, in which case the pressure sensors could be positioned out of sight, provided that they still bracketed the refining means 52, to provide a pressure differential across the refining means 52, so that the measured pressure differential can be correlated to degree of viscosity change through the refining means 52.

Further downstream there is shown a lubricator 62, which is in the form of a water annulus. Essentially the lubricator 62 works by introducing a thin annulus of water around the explosive composition 11, namely between the explosive composition 11 and the hose or conduit 63, to reduce the friction between the moving explosive 11 and the stationary hose 63. The water would be added by means of a water line 64. Such devices are known and thus are not described in any more detail herein. The lubricator 62 is not always necessary and the equipment can be used without lubrication as needed. However lubrication helps to service boreholes that may be located a fair way away from the source of pumpable explosive 12 and thus require a long hose 63.

The end 66 of the conduit or hose 63 is where the pumpable explosive exits the conduit into a borehole or the like. An inflatable packer 68 may be located at the conduit end 66. This equipment is also suitable for loading an upwardly inclined borehole. In his case the end of the emulsion hose end 66 with the inflatable packer 68 is placed into a borehole opening. The depth of insertion may vary. When the packer 68 is inflated to form a tight immovable collar the hose is locked into position.

Figure 2:
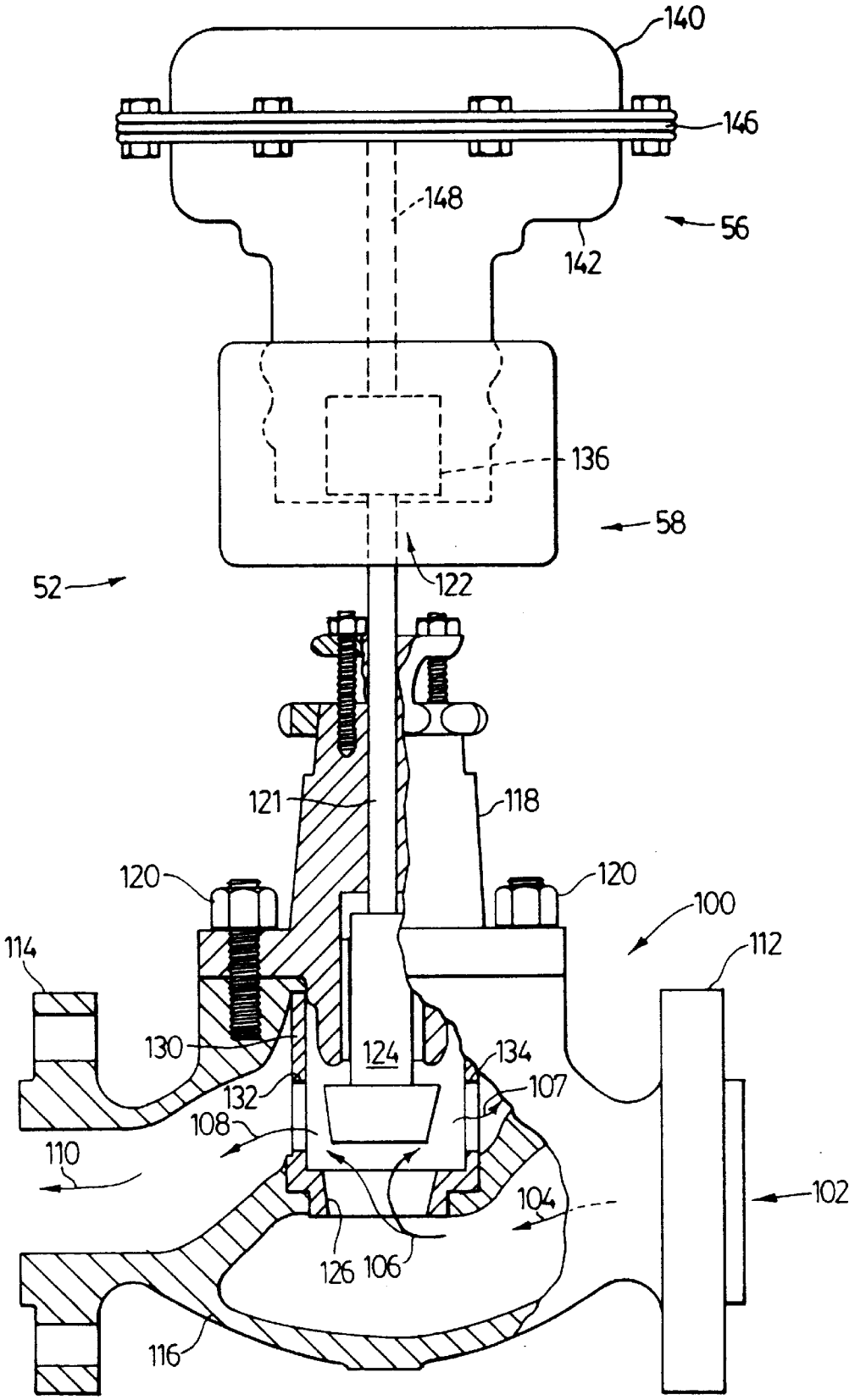
FIG. 2 is a view of a preferred shear valve according to the present invention.

Turning to FIG. 2, the details of the preferred refining means 52, in the form of globe valve 100, with spring diaphragm actuator 56 and an electropneumatic valve positioner 58 is shown. In this sense globe valve describes any valve in which the material flowing through the valve (in this case pumpable explosive 11) describes a generally S shaped path as indicated by arrows 102 to 110 through the valve.

The globe valve 100 has an upstream flange 112 and a downstream flange 114 and a valve casing 116. Also shown is a valve stem packing element 118 which is attached by bolts 120 to the valve casing 116. A valve stem 121 is located in the packing element 118, and has an upper end 122 which extends into the valve positioner 58. At the lower end of the valve stem 121 is the valve plunger 124. The valve plunger mates with a valve seat 126. A flow equalizer is shown at 130, and is essentially in the form of a cylinder with four holes evenly spaced around the perimeter. Two such holes 132 and 134 are shown.

Located within the valve positioner is a mechanical linkage element 136 which enables fine adjustments of the valve to be made as the valve plunger 124 approaches the valve seat 126. Located above the mechanical linkage element 136 is the spring diaphragm actuator 56, with an upper casing 140, a lower casing 142 and a diaphragm 146. An element 148 connects the diaphragm 146 with the linkage element 136.

It will now be appreciated how the preferred form of the invention operates. As the volume of fluid is changed above the diaphragm 140, the diaphragm 140 will be forced to deflect. Deflection through the element 148, linkage 136, and stem 121 causes the valve plunger 124 to move relative to the valve seat 126. The greater the deflection, the closer the valve plunger 124 gets to the valve seat 126, in turn creating more shear in the fluid passing through the valve. Most of the shearing will occur in the vicinity of the arrow 106.

It will be appreciated that other mechanical configurations and equipment could be substituted for the elements described above, provided that there was provided pressure readings on either side of the refining means 52 to allow for controlled refining of pumpable explosive compositions 11 in light of changes in pumping conditions.

The method of operation of the system can now be understood. To optimize the operation of the equipment it will be necessary to calibrate the particular equipment configuration to determine what amount of refining will equate to what degree of shear thickening for a particular explosive composition 11. What has been discovered is that the degree of refining can be calibrated to the pressure drop across the valve doing the refining. Thus, monitoring the pressure differential across the refining means 52, allows for the monitoring of the amount of refining.

In the equipment as described above, a calibration test was conducted as follows. A flow rate of pumpable explosive composition having an initial viscosity of 650,000 cps was pumped through the valve means at a rate of 100 lbs per minute. The actuator on the valve means was adjusted to show a pressure reading of 300 psig at the first pressure sensor, while the second pressure sensor read 150 psig for a difference of 150 psig. At this pressure drop a thickening of the explosive composition occurred to 1,100,000 cps, which is deemed to be optimal for borehole loading. It will be appreciated that the calibration results are quite specific and thus different equipment configurations and different explosive compositions will have different pressure differential requirements to achieve optimal refining. What is important is to provide a measure of the amount of refining, which the correlation to pressure drop provides.

The preferred manner of loading a borehole can now be understood. The first step is to ensure that an adequate supply of pumpable explosive is on hand. Then, the pump means 14 is started and brought to a preferred initial pump speed of 180 RPM. The refining means 52 or globe valve is then adjusted to achieve the target pressure differential. For the equipment described above, the target pressure differential was calibrated at about 150 psi. Pumping will then take place, at the 150 psi pressure differential.

The maximum pressure on the upstream side (pressure indicator 50) must be monitored and should not exceed 400 psi although it is preferred to operate at pressures below 375 psi. The typical operating range is between 300 to 350 psi Thus the downstream pressure will typically run at between 150 to 200 psi This downstream pressure is thus the pumping pressure, namely the pressure that provides the motive force to the pumpable explosive to transport the pumpable explosive to and into the borehole.

As pumping progresses, the pumping pressures are continually monitored. As the pressure differential rises or falls according to changes in pumping conditions, adjustments can be made in real time to the refining means 52, to open or close valve 100, to maintain the target or set point pressure differential, which for this equipment is 150 psi.

In loading an up borehole, as the column of pumpable explosive rises in the borehole, back pressure win increase due to hydraulic head (vertical column pressure) as well as friction in the borehole. This will be passed though the system and will result in a rise of pressure at the downstream side of the shear valve. This in turn causes the pressure differential to drop across the valve. This then requires that the valve be closed more to keep up the desired pressure differential to maintain the shearing at a desired level. This in turn increases the pressure on the upstream side of the valve, making it harder for the pump to pump. This has the effect of slightly slowing the pump down, as it works harder, which also has the effect of reducing pumping rate which has the effect that the pressure drop across valve is reduced, requiring the valve to be closed even more to increase shear to keep it at the desired pressure level. This dynamic interaction will continue until the upper pre operating limit is approached of about 375 psi, at which time, a change is required to prevent pressure release or rupture.

The change that is made is to fairly dramatically reduce the pump speed. At a lower pumping speed there will be reduced pressure upstream of the valve. This process can be repeated, although it will be appreciated that eventually the pumping head becomes too great for the system to pump further.

Figure 3:
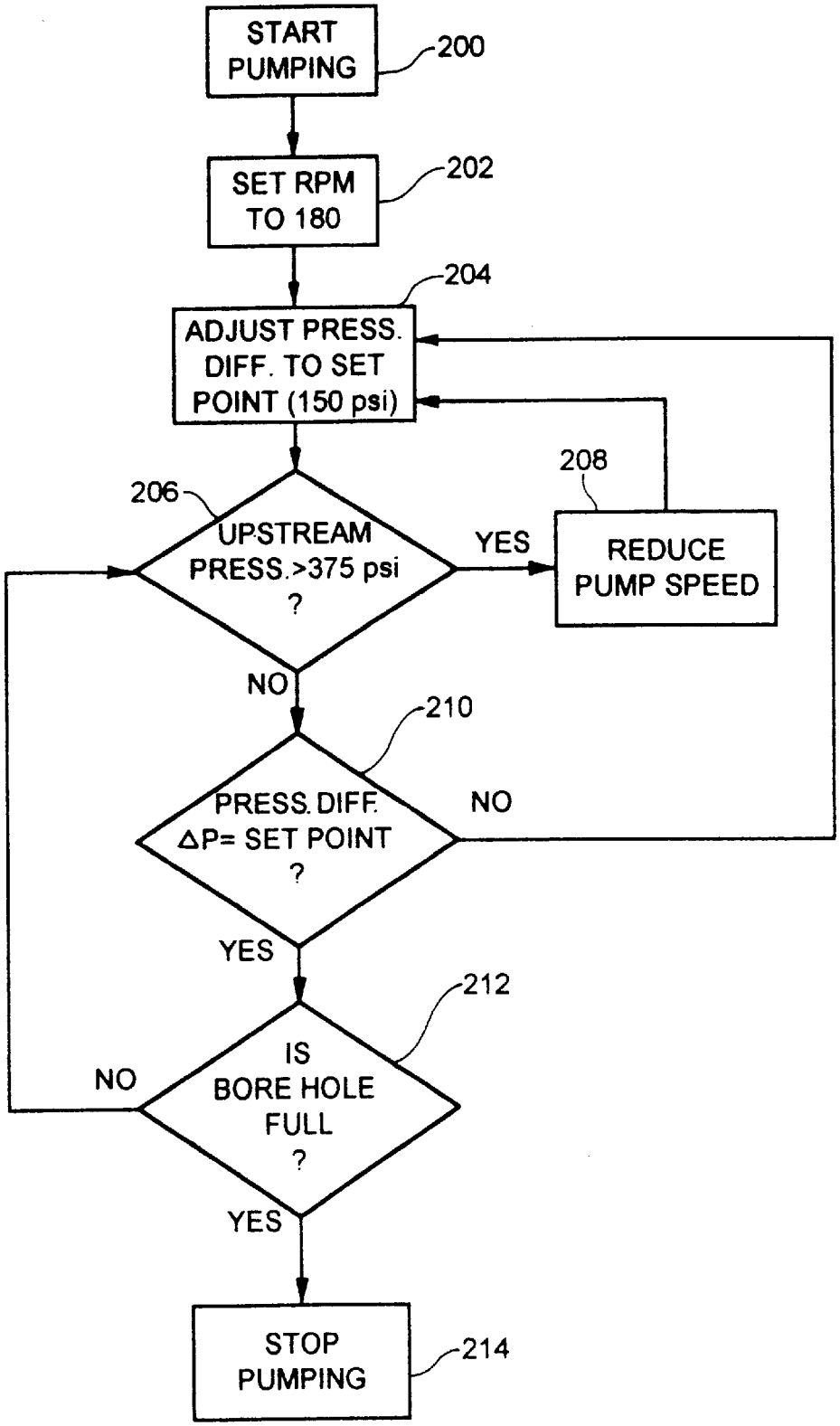
FIG. 3 is a flow chart for a preferred control system according to the present invention.

It will be appreciated that the above described system can be manual controlled, with an operator monitoring both pressure differentials and pump speed or it may be automated through use of a control system. Turning to FIG. 3, there is shown a flow chart of logic for a control system for the instant invention. It will be appreciated that components of the instant invention can be configured to generate electronic signals proportional to the quantity being measured. Thus each of the first pressure gauge, the second pressure gauge and the valve and the pump can be instrumented to produce control signals for a microprocessor based control system. There would need to be appropriate signal processing to convert analogue to digital signals and calibrate the sensors and the like, but these techniques are well known to those skilled in the art and thus are not described in any more detail herein.

In the central microprocessor (A 486 or Pentium processor for example), there can be a preferred control algorithm to effect the control of the components according to preset operating parameters such as an initial pump speed, and an initial set point pressure differential. In this case these would be set at 180 RPM and 150 psi respectively. The first box 200 represents the starting step which is to start the pump. Then, the system produces an output signal to a motor controller to set a specific pump speed, shown as 202. Then in step 204 the system adjusts the shear valve to set a pressure differential; to the set point pressure differential which in this example is 150 psi.

The next step 206 is to perform a comparative function and to check if the upstream side of the valve is reading a pressure above 375 psi. If it is, the a signal is sent to the pump to slow the pump down which is shown as step 208. If it is not the program moves on to the next step 210.

In step 210, the program compares the preset pressure differential to the actual pressure differential, and if a difference is detected, the program returns to step 204 which is to generate an output sign to control the adjustable actuator to vary the shear through the valve. Once the set point pressure is achieved, the program continues with repeating steps 206 to 210.

One check is in step 212, which is to see if the borehole is full. This would involve pre-inputting the borehole depth and performing a volume calculation in real time to determine how much pumpable explosive was inserted into the borehole. If the rig total coincides with the desired total amount, then the program proceeds to step 214, which causes the pump to stop. If there is still material to pump, then the program returns to step 206 to continue monitoring the pumping functions.

It will be appreciated that certain refinements are possible to make the system operate smoothly. For example, the system can be set up for any sampling rate, but several times a second would be adequate. Also, to prevent the equipment from reacting too quickly, preselected reading differentials can be chosen. For example, if the differential pressure has only changed by 1 psi, the equipment will be programmed not to respond. However, if it detects a more significant change, say 3 or 4 psi, then it will react. Establishing such reaction thresholds will be subject to individual preference, provided that a reasonable responsive and practical result is obtained.

One of the aspects of this invention is the real time monitoring of the pressure drop across the valve 100 during use. The pressure can vary, due to changes in pumping conditions. Some changes in pumping conditions include an increase in vertical head pressure when loading a vertically or upwardly inclined borehole. There may be changes in the viscosity of the pumpable explosive being fed into the apparatus from the bulk storage tank. Another reason could be for example a blocked bleeder tube which could also cause the pressure to vary.

The real time monitoring of the pressure drop across the valve 100 allows for a real time adjustment of the valve 100 to maintain the optimal (calibrated) pressure differential. The present invention comprehends two ways to keep the pressure at the predetermined optimum. The first way is to station a person at the first and second pressure sensors to monitor the pressure difference and manually adjust the valve as needed. A second way is to put in place a computer driven control system, which collects the pressure readings from the first and second pressure sensors electronically, computes the difference, and the compares the result to a predetermined and pre-input desired pressure. In the event that the pressure varies from the ideal pressure by more than a preset amount an out put signal is generated to cause the actuator to move as required to reach the pre-set pressure. The actuator can be in the form of a hydraulically or electrical activated motor.

In both cases it may also be necessary to vary the pump speed. For example, the preferred maximum pumping pressure is 400 p. Above this pressure will cause the rupture disk to fail. However there may still be additional explosive required in the borehole. The valve 100 cannot be adjusted though be cause to do so wold cause an excessive pressure. Thus it may be necessary to lower or reduce the pump speed, thereby lowering the pressure. By lowering the pump speed the pressure differential can again be obtained across the valve and the pumping operation continued. In this manner even up holes can be loaded with a consistently refined composition 11 to in excess of 100 feet, without much difficulty.

It will be appreciated that although either way would provide good results, the automated system is preferred because of the reduced labour required to operate the equipment. It has been found that by constant adjustment of the valve means a more consistent result can be achieved, with the result of a more consistently thickened explosive composition having a higher overall viscosity. This is because the valve means provides a consistent shear to the explosive composition regardless of the back-pressure created downstream of the valve means. In a sense this device can be characterised as operating by means differential pressure as opposed to absolute pressure as in the prior devices.

It will further be appreciated that the instant invention teaches controlling the degree of refining, in this case through a shearing globe valve 100, to facilitate achieving consistent shearing results. This provides a more consistently thickened composition, even though pumping conditions might have changed during the loading process. However, in its broadest comprehension this invention contemplates instrumenting a refining apparatus with a control means which provides a measured parameter for controlling refining. While the preferred parameter is pressure, those skilled in the art will appreciate that other parameters such as fluid speed or viscosity might also be chosen. This invention is intended to comprehend those other parameters which allow for a substantially real time monitoring of the refining of the fluid. Finally, it will be appreciated that by introducing the water annulus downstream or after the refining means, the mixing of the lubricating fluid into the explosive composition is substantially avoided.

It will be appreciated by those skilled in the art that the foregoing demonstration is by way of example only and that there are various modifications and alteration to the form of the invention that can be made without departing from the broad scope of the invention as defined in the following claims. Some of these variations have been discussed above and others will be apparent to those skilled in the art. For example although the preferred form is to measure pressure through a globe valve which is simple efficient and easy to use, other types of refining elements could be used.

We claim:

1. A method for controlled pumping and thickening of a pumpable explosive, the method comprising the steps of:

a) pumping an explosive composition through a shear thickening apparatus having a refining means;

b) measuring pressure at a first pressure indicator located on an upstream side of said refining means;

c) measuring pressure at a second pressure indicator located on a downstream side of said refining means;

d) providing an adjustor associated with said refining means;

e) establishing a set point pressure differential between said measured upstream and downstream pressures for attaining a predetermined amount of thickening of said explosive composition passing through said refining means;

f) monitoring the measured pressure difference between the first pressure indicator and the second pressure indicator; and g) adjusting said shear thickening apparatus to generally maintain said set point pressure differential.

2. A method for controlled pumping and thickening of a pumpable explosive as claimed in claim 1 wherein said step of establishing a set point pressure differential includes performing a calibration test to correlate a pressure difference between said first pressure indicator and said second pressure indicator with an amount of shear thickening.

3. A method for controlled pumping and thickening of a pumpable explosive as claimed in claim 1 wherein said step of monitoring the pressure difference comprises subtracting a measured pressure on one side of said refining means from a pressure measured on another side of said refining means and computing the difference.

4. A method for controlled pumping and thickening of a pumpable explosive as claimed in claim 1 wherein said shear thickening apparatus includes a pump, and wherein said step of adjusting said shear thickening apparatus includes adjusting one or both of said pumps' speed and said adjustor to return the monitored pressure difference to the established set point pressure differential.

5. A method for controlled pumping and thickening of a pumpable explosive as claimed in claim 1, wherein said shear thickening apparatus includes a conduit, and said step of pumping said explosive composition includes lubricating said conduit downstream from said refining means.

6. A method for controlled pumping and thickening of a pumpable emulsion explosive composition comprising:

a) shear thickening said emulsion explosive composition in an instrumented apparatus for pumping explosive compositions;

b) measuring said emulsion explosive composition being shear thickened with said instrumented apparatus;

c) calibrating said measurements of said emulsion explosive composition to correlate said measurements from said instrumented apparatus to an amount of shear thickening; and d) controlling said shear thickening to achieve a desired degree of shear thickening as established by said step of calibrating.

7. A method for controlled pumping and thickening of a pumpable explosive composition as claimed in claim 6 wherein said step of refining said explosive composition comprises passing said composition through a shear valve.

8. A method for controlled pumping and thickening of a pumpable explosive composition as claimed in claim 7 wherein said step of calibrating comprises measuring a pressure differential across the shear valve and correlating said measured pressure differential to the amount of viscosity of the reed explosive composition.

9. A method for controlled pumping and thickening of a pumpable explosive composition as claimed in claim 8 wherein said apparatus includes a pump, and said step of controlling said refining includes one or both of adjusting said shear valve to vary said pressure differential and changing a speed of said pump.

* * * * *